US006862509B2

(12) United States Patent
Rau et al.

(10) Patent No.: US 6,862,509 B2
(45) Date of Patent: Mar. 1, 2005

(54) DEVICE FOR OPERATING THE ARTICULATED MAST OF A LARGE MANIPULATOR

(75) Inventors: Kurt Rau, Obermühle (DE); Hartmut Benckert, Filderstadt (DE)

(73) Assignee: Putzmeister Aktiengesellschaft (DE)

( * ) Notice: Subject to any disclaimer, the term of this patent is extended or adjusted under 35 U.S.C. 154(b) by 73 days.

(21) Appl. No.: 10/433,316

(22) PCT Filed: Oct. 6, 2001

(86) PCT No.: PCT/EP01/11536

§ 371 (c)(1),
(2), (4) Date: Jun. 2, 2003

(87) PCT Pub. No.: WO02/44499

PCT Pub. Date: Jun. 6, 2002

(65) Prior Publication Data

US 2004/0052627 A1 Mar. 18, 2004

(30) Foreign Application Priority Data

Dec. 1, 2000 (DE) ..... 100 60 077

(51) Int. Cl.[7] ..... E02F 9/20
(52) U.S. Cl. ..... 701/50; 701/36; 212/284
(58) Field of Search ..... 701/35, 50, 36; 212/284, 285, 288, 291; 37/234, 348

(56) References Cited

U.S. PATENT DOCUMENTS 5,626,194 A * 5/1997 White ..... 169/24
5,836,398 A * 11/1998 White ..... 169/24
5,848,485 A * 12/1998 Anderson et al. ..... 37/348
6,532,409 B1 * 3/2003 Fujishima et al. ..... 701/50

* cited by examiner

*Primary Examiner*—Richard M. Camby
(74) *Attorney, Agent, or Firm*—Pendorf & Cutliff

(57) ABSTRACT

A device for operating an articulated arm of a large manipulator connected to a boom base. The large manipulator comprises an articulated boom (22), composed of three boom arms (23 to 27), the boom arms of which may each be pivoted around mutually parallel horizontal articulation axis (28 to 32), in a limited manner. Furthermore, a control device (74), for the boom displacement is provided, which may be controlled from a remote controller (50) over a data transmission path (68). The remote controller comprises a first and a second remote control device (60, 62), each of which may be adjusted in at least one main control direction and thereby providing an output signal (64, 66), while the control device (74) comprises a computer supported coordinate transformer (80), responsive to the output signal (64) from the first remote control device (60), by means of which the drive units (34 to 38) for the redundant articulation axes may be operated in the one main control direction (r) of the first remote control device (60), according to the pattern of a pre-determined path-angle relationship. According to the invention, in order to match the boom configuration to differing operating tasks, the control device (74) comprises a correction routine (84) based on the output signal (66) from the second remote control device (62), by means of which the drive unit of a selected articulation axis may be preferably operated in one of the main operating directions of the second remote control device (62).

32 Claims, 2 Drawing Sheets

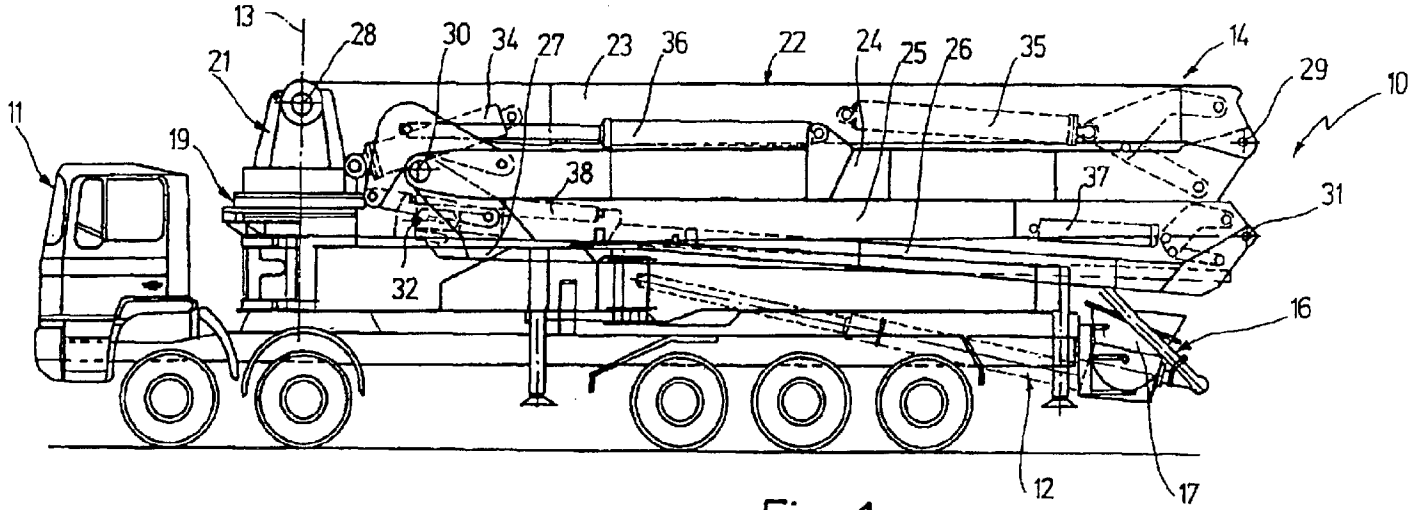
Fig. 1
Fig.2
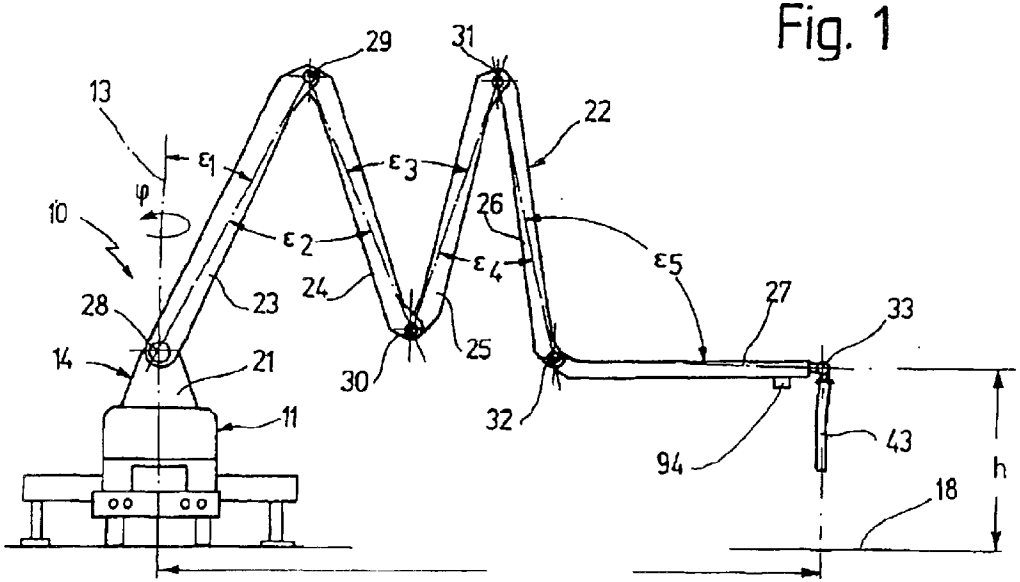

DEVICE FOR OPERATING THE ARTICULATED MAST OF A LARGE MANIPULATOR

CROSS REFERENCE TO RELATED APPLICATION

This application is a national stage of PCT/EP01/11536 filed Oct. 6, 2001 and based upon DE 100 60 077.8 filed Dec. 1, 2000 under the International Convention.

BACKGROUND OF THE INVENTION

1. Field of the Invention

The invention concerns a device for operating an articulated mast or boom connected to a boom base, and in particular a concrete placement boom carrying a placement hose on the end of the boom, which articulated boom includes at least three boom arms which may each respectively be limitedly pivoted relative to the boom base or relative to an adjacent boom arm about parallel horizontal articulation axes via respectively one drive unit, which boom base is mounted to a frame and is pivotable preferably 360° about a vertical axis. The operating device includes a control device for movement of the boom as well as a remote controller communicating with the control device via preferably a wireless data transmission pathway, which remote controller comprises a first and a second remote control device, each of which may be adjusted manually back and forth in at least one main control direction and thus providing an output signal. The control device comprises a computer supported co-ordinate transformer, responsive to the output signal from the first remote control device, via which the drive units for the redundant articulation axes may be operated in the one main control direction of the first remote control device in any rotation position of the boom base, and independent of the drive unit for the rotation of the boom base, for extending or retracting the articulated boom according to the pattern of a pre-determined path-slew relationship. The invention further concerns a large manipulator, particularly for concrete pumps, with an articulated boom connected to a boom base and a device for operation thereof as described above.

Mobile concrete pumps are conventionally controlled by an operator who is responsible for controlling, using a remote control device, the pumping as well as positioning the placement end of a hose provided at the tip of the articulated boom. The operator must control multiple rotational degrees of freedom of the articulated boom via the associated drive units with movement of the articulated boom in non-structured three-dimensional work space with due consideration of the construction site boundary conditions. The single axis operation has on the one hand the advantage that the individual boom arms can individually be brought into any desired position limited only by their pivot range. Each axis of the articulated boom and the boom base is therein associated with one main control direction of the remote control device, so that above all in the case the presence of more than three boom arms the operation is manageable. The operator must maintain control over not only the axes but also the hose end, in order to avoid the risk of uncontrolled movement of the hose end and therewith an endangerment of the construction site personnel.

2. Description of the Related Art

In order to simplify the manipulation in this respect, an actuation device has already been proposed (DE-A 43 06 127), in which the redundant articulated axes of the articulated boom are controllable collectively with one single control manipulation of the remote control device, in any rotational position of the boom base, independent of the rotation axes thereof. Therein the articulated boom carries out an extension and retraction movement which is easily overseen by the operator, wherein the elevation or height of the boom tip can in addition be maintained constant. In order to make this possible, the control device includes a remote control device controllable computer supported coordinate transmitter for the drive units, via which the drive units of the articulated boom are actuated in the one main adjustment direction of the remote control device independently of the drive unit of the rotation of the boom base with accomplishment of an extension or retraction movement of the articulated boom while maintaining a predetermined height of the boom tip. In a different main adjustment direction of the remote control device the drive unit or drive unit of the rotation axes of the boom base is operable independent of the drive units of the articulated axes with carrying out a rotation movement of the articulated boom, while in a third main adjustment direction the drive units of the articulated axes are operable independent of the drive units of the rotation axes with carrying out of a raising and lowering movement of the boom tip. For optimizing the movement sequence during the extension or retraction process, it is considered to be important therein that the drive units of the redundant articulated axes of the articulated boom are operable respectively depending upon the pattern of a path-slew characteristic. Further associated therewith is that the path-slew characteristic is modified in the coordinate transformer depending upon the value of bending and torsion moments related to load acting upon the individual boom arms. Further, there the path-slew characteristics are limited in the coordinate transformer depending upon the value of the boom arm movement spatial collision zones, in particular by predetermination or pre-programming of a highest and/or lowest articulation point.

The use of the computer supported coordinate transformer is limited when it is necessary to carry out movement sequences deviating from the predetermined path-slew characteristic of the articulated boom, for example in order to pass the boom through a narrow opening or when for a particular task a defined positioning or arrangement of the one or the other boom arms is necessary. In this case it has until now been necessary to switch from the computer supported boom control in cylindrical coordinates to an individual control of the individual articulated axes with an appropriate number of main adjustment directions in the remote control devices. Besides this, the risk associated with the individual operation of the axes must be accepted.

SUMMARY OF THE INVENTION

Beginning therewith it is the task of the invention to improve the known operating devices of the above described type in such a manner that also in the case of a computer supported control of the articulated boom, depending upon the value of a predetermined path-slew characteristic, and taking into consideration redundant articulated axes, it becomes possible for an operator to easily oversee an influencing of the boom configuration targetedly departing from the path-slew characteristic during the movement sequence.

For the solution of this task the combination of characteristics set for in claims 1, 3, 5, 15, 17 and 19 is proposed. Advantageous embodiments and further developments of the invention can be seen from the dependent claims.

The inventive solution is based upon the idea, that individual of the redundant axles can be selected by the operator and be preferentially controlled, wherein the position and/or movement of the boom tip input into the first remote control device is maintained by automatic following or compensated control of the remaining articulated axes.

In order to make this possible, it is proposed in accordance with the invention, that the control device includes a correction routine responsive to the output signal of the second remote control device, via which in one of the main adjustment directions of the second remote control device the drive unit of a selected articulation axes with maintenance of the position and/or movement of the boom tip input into the first remote control device with maintenance of the drive unit of at least one of the remaining articulated axes is preferentially operable. It is envisioned with a preferred embodiment of the invention that the first remote control device includes three main adjustment directions, which associate the coordinate of the boom tip with a cylindrical coordinate system referenced to the vehicle frame fixed rotation axis of the boom block. Thereby is becomes possible for example to guide the articulated boom through a narrow opening while taking advantage of the benefits of the computer supported operation of the cylindrical coordinate system, which in the case of the utilization of the existing path-slew characteristics would represent a collision impediment. Further, hereby it becomes possible to carry out a desired change of the boom configuration as desired by the operator while at the same time maintaining first remote control device at a zero or null setting to thereby keep the boom tip stationary.

A further preferred or alternative design of the invention envisions that the control device includes a correction routine responsive to the output signal of a second or a third remote control device via which in one of the main adjustment directions of the concerned remote control device the inclination or spatial angle of the articulated boom plane relative to the vertical of a selected articulation arm is adjustable for further movement sequences with maintenance of the predetermined position and/or movement of the boom tip as input by the first remote control device. Thereby it becomes possible for example to bring the end arm into a horizontal orientation for a particular concretization task and to maintain it in this orientation during the further movement sequence by using the correction routine. Alternatively it could be highly desirable, for example when concretizing high floors, to bring the first boom arm linked to the boom base into an almost vertical orientation and to maintain it in this orientation during the remaining movement sequences.

A third preferred or alternative design of the invention envisions that the control device includes a correction routine responsive to an output signal of a further remote control device, via which in one of the main adjustment directions of the concerned remote control device the linkage of a selected articulation axis is lockable, preferably with a predetermined articulation angle. Thereby it is possible to rigidly couple two boom arms, for example the last arm and the next to the last arm, and thereby to achieve for special cases an easily managed movement sequence.

A particularly simple manipulation or operation is achieved when there is provided,

- a selection device for selection of the articulation axis operable via the second remote control device
- and/or a selection device for selection of the boom arm of which inclination angle is to be maintained via the second or third remote control device
- and/or a selection device for selection of the articulation axis to be locked via the additional remote control device.

For further improvement of the operating safety and reliability it is proposed in accordance with the invention that the control device includes an interpolation routine responsive to the amount or value of the output signal of the remote control device for setting and limiting the movement speed of the drive units.

Preferably the coordinate transformer includes a transformation routine, that is, a program for converting the cylindrical coordinates defined by the output signal of the first remote control device into angle or path coordinates depending upon the value of the predetermined path-slew characteristic. Preferably therein the individual drive units are associated with respectively one angle or path measurement system, wherein the transformation routine is fitted out with a position controller which can be acted upon with the output data of the angle or path measurement system as actual values. The uniqueness of the invention is thus comprised therein, that the transformation routine and the correction routine are connected on the output side with a coordinate adder, with the output data of which the intended value input of the position controller can be influenced. The automatic following of the remaining articulated axes occurs thereby, that the output data of the coordinate adder is coupled back to the input side of the transformation routine via a forward transformation routine and a coordinate comparator.

BRIEF DESCRIPTION OF THE DRAWINGS

In the following the invention will be described in greater detail on the basis of an illustrated embodiment shown schematically in the figures. There is shown FIG. 1 a side view of a mobile concrete pump with folded together articulated booms;

FIG. 2 the mobile concrete pump according to FIG. 1 with articulated boom in a work position;

DETAILED DESCRIPTION OF THE INVENTION

Figure 3:
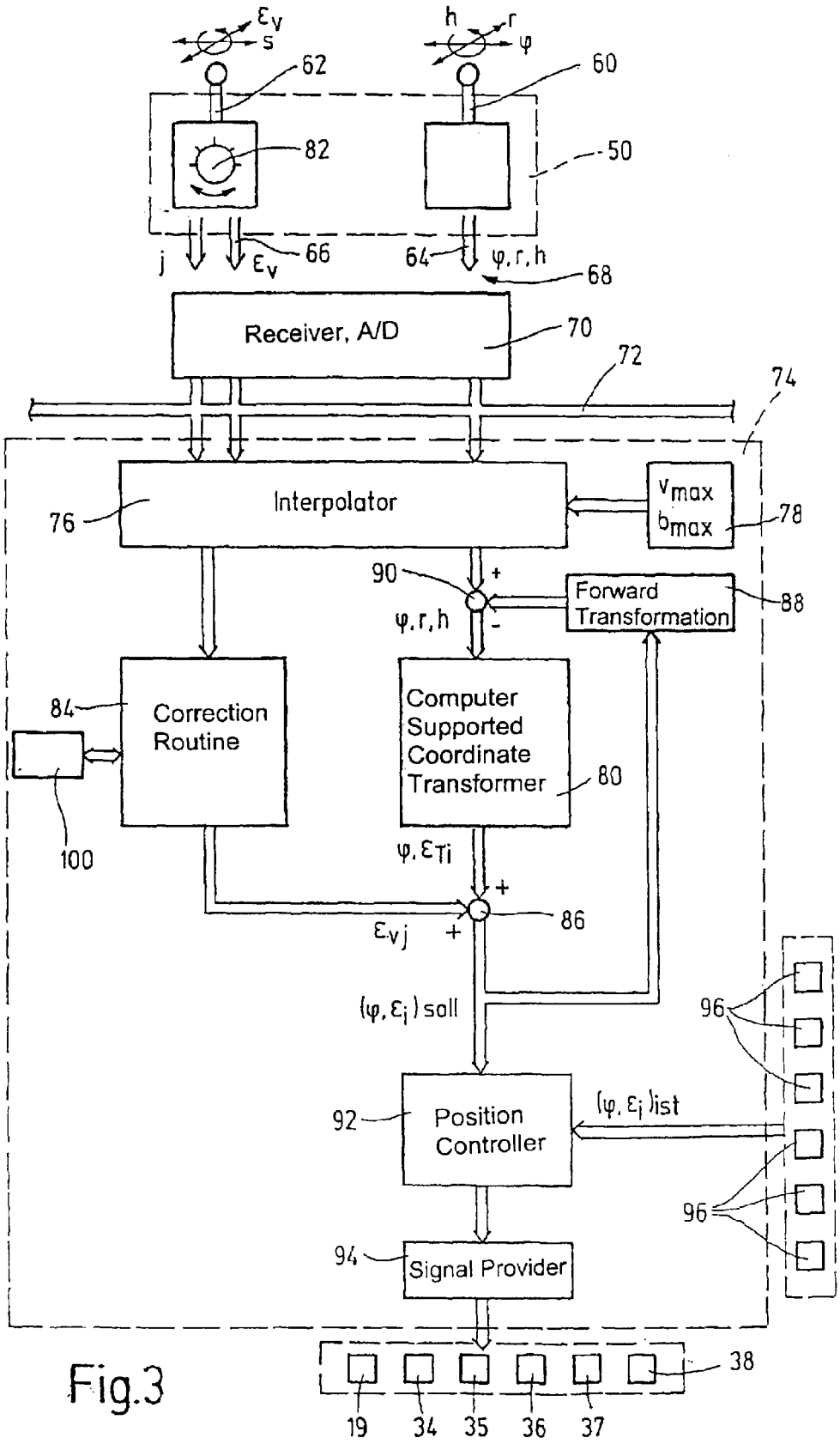
FIG. 3 the schematic of a device for operating the articulated boom.

The mobile concrete pump 10 includes a transport vehicle 11, a thick matter pump 12 which is, for example, a two cylinder piston pump as well as a concrete placing boom 14 as carrier for a concrete conveyance line 16 rotatable about a vehicle fixed vertical axes 13. Liquid concrete, which is continuously introduced into a supply reservoir 17 during concreting, is conveyed via concrete conveyance line 16 to a concreting location 18 located remote from the location of the vehicle 11.

The distribution boom 14 is comprised of a boom base 21 rotatable about the vertical axis 13 by means of a hydraulic rotation drive 19 and an articulated boom 22 mounted pivotably thereto, which is continuously adjustable to various reaches and height differences between the vehicle 11 and the concretization location 18. The articulated boom 22 is comprised in the illustrative embodiment of five boom arms 23 to 27 connected to each other by articulated linkages, pivotable about axes 28 to 32 extending parallel to each other and at right angles to the vertical axis 13 of the boom base 21. The articulation angle $\epsilon_1$ to $\epsilon_5$ (FIG. 2) of the articulation linkages formed by the articulation axis 28 to 32 and their relation to each other are so coordinated to each other that the distribution boom 14 can be folded into the space-saving, multiple-folded transport configuration on the vehicle 11 as can be seen from FIG. 1. By the actuation of the drive units 34 to 38, which are individually assigned to the articulation axis 28 to 32, the articulated boom 22 can be unfolded out to various distances r and/or height differentials h between the concreting location 18 and the vehicle location (FIG. 2).

The operator uses a wireless remote controller 50 to control the boom movement, whereby the boom tip 33 and the hose end 43 are moveable over the area to be concreted. The hose end 43 has a typical length of 3 to 4 m and can, due to its articulated hanging in the area of the boom tip 33 and due to its own flexibility, be held with its output end by a hose-man in a desired position for concreting 18.

The remote controller 50 includes, in the shown embodiment, two remote control devices 60, 62 in the form of control levers, which respectively can be moved back and forth in three main control directions with output of control signals 64, 66. The control signals are transmitted over a radio path 68 to the vehicle-fixed radio receiver 70, of which the output side is connected to a micro-controller 74 via for example a bus system 72 in the form of a CAN-bus. The micro-controller 74 includes software modules 76, 80, 84, via which the control signal 64, 66 received from the remote control device 50 is interpreted, transformed and via a position controller 92 and a subsequent signal provider 94 is converted to actuation signals for the drive units of the articulated axes and the boom base rotation axis.

In the illustrative embodiment shown in FIG. 3 the output signal of the remote control element 60 is interpreted into the three main adjustment directions "tilting forwards/backwards", "tilting left/right" and "rotating left/right" for adjusting the radius r of the boom tip 33 from the rotation axes 13, for controlling the rotation axes 13 of the boom base 21 and the angle $\phi$ and for adjusting the height h of the boom tip 33 above the concreting location 18.

The deflection of the remote control element 60 in the respective direction is translated into a speed signal in the interpolator routine 76. Limitation value data 78 ensures that the movement speed of the axis, and their acceleration, does not exceed a predetermined maximal value $v_{max}$ and $b_{max}$.

Downstream of the interpolator-routine 76 is a software module referred to as a coordinate transformer 80, of which the primary task is to transform the incoming control signals, interpreted as cylindrical coordinates $\phi$, r, h, in predetermined time steps into angular signals $\phi$, $\epsilon_I$ for the rotation and articulation axes 13, 28 through 32, wherein the drive units of the redundant articulation axes 28 to 32 of the articulated boom 22 are respectively operable depending on the value of a predetermined path-slew characteristic. Each articulation axes 28 to 32 is controlled by software within the coordinate transformer 80, such that the articulation linkages are moved harmonically relative to each other depending upon path and time. The controlling of the redundant degrees of freedom of the articulation linkages thus occurs depending upon a preprogrammed strategy, via which also the self-collision with adjacent boom arms 23 to 27 can be precluded during the course of movement. For increasing the precision reliance resort may be made, besides this, to correction data stored in the memory for compensation of a load-dependent deformation. In this manner angular changes $\phi$, $\epsilon_{Ti}$ calculated in the coordinate transformer 80 are compared in the position controller 92 with the actual values $\phi$, $\epsilon_i$ determined by the angle provider 96 and converted via the signal provider 94 into actuation signals 98 for the drive units 19, 34 through 38.

A unique feature of the device shown in FIG. 3 is comprised in that the remote controller 50 includes a second remote control device 62 as well as a selection device 82, via which individual articulation axes 28 to 32 or boom arms 23 to 27 can be preferentially controlled in the course of their movement. Therewith it is also possible with a simple manual manipulation to modify the preset path-slew characteristics provided by the coordinate transformer 80 with respect to axes or arms, in order to be able to carry out particular manipulations of practical commercial relevance. Via the selection device 82 a particular articulation axis j or a specific boom arm j is selected. By the operation of the second remote control element 62 the output signals are then interpreted in the one main direction as preferred changes in the inclination angle $\epsilon_{Vj}$ or bend angle j and subjected to an evaluation in the correction routine 84. The modified and, in certain cases, corrected value of the process change by angle $\epsilon_j$ is subjected to the transformed value $\epsilon_{Tj}$ in the coordinate adder 86 and supplied to the position controller 92. The following or subordinated guiding of the remaining articulation axes, which is necessary on the basis of the pre-input at the first remote control element 60 in the redirection, occurs thereby, that the output value of the coordinate adder 86 is reverted back via a forwards transformation routine 88 and a coordinate comparator or coordinate subtractor 90 to the input side of the transformation routine. The coordinate transformer 80 then ensures for the desired following of the remaining linkage coordinates depending upon the value of the intended value input at the remote control element 60.

A second variant of the device shown in FIG. 3 envisions that in a second main adjusting direction s of the second remote control element 62 the instantaneous position of the boom arm j selected via the selection switch 82 is stored in a memory 100 with respect to its spatial orientation. The storage can occur at the conclusion of a preferred movement of the associated drive unit. The orientation data of the concerned boom arm j is then continuously taken into consideration during a further movement sequence, which is input via the first remote control element 60, via the correction routine 84. During movement of the second remote control element 62 in the direction counter to the stored movement s the memory 100 can again be erased and the preferred orientation or alignment of the concerned boom arm j can be resumed. Thereby it becomes possible for example to orient and store the end arm 27 in the horizontal orientation shown in FIG. 2, and to maintain it in this orientation during the further sequence of movement during operation of the first remote control element 60. A further possible application is comprised therein, that the first boom arm 23 linked to the boom base 21 is brought to a substantially vertical orientation for concreting of a higher floor, and is maintained in this orientation during the course of the subsequent movement sequence.

A third variant of the arrangement shown in FIG. 3 envisions that in a further main adjustment direction of the second remote control element 62 the bend angle $\epsilon_v$ of the articulation axis j selected by the selection switch 82 is stored in a memory 100. The storage can occur at the conclusion of a preferred movement of the associated drive unit. The bend angle $\epsilon_V$ of the concerned articulation axis j is then continuously kept the same via the correction routine 84 during a further movement sequence which is determined by the first remote control element 60. Upon operation of the additional remote control element 62 in the direction opposite the memory movement s then memory 100 can again be erased and the locking of the linkage at the concerned articulation axes j can be suspended. Thereby for example the end arm 27 can be rigidly coupled with the next to the last arm 26 during operation of the first remote control element 60.

In summary the following can be concluded: The invention is concerned with a device for operating an articulated arm of a large manipulator coupled to a boom base. The large manipulator comprises an articulated boom 22, composed of three boom arms 23 to 27, the boom arms of which may each be pivoted around mutually parallel horizontal articulation axis 28 to 32, in a limited manner. Furthermore, a control device 74 for the boom displacement is provided, which may be controlled from a remote controller 50 over a data transmission path 68. The remote controller comprises a first and a second remote control device 60, 62, each of which may be adjusted in at least one main control direction and thus providing an output signal 64, 66, whilst the control device 74 comprises a computer supported coordinate transformer 80, responsive to the output signal 64 from the first remote control device 60, by means of which the drive units 34 to 38 for the redundant articulation axes may be operated in the one main control direction r of the first remote control device 60, according to the pattern of a pre-determined path-angle relationship. According to the invention, in order to match the boom configuration to differing operating tasks, the control device 74 comprises a correction routine 84 based on the output signal 66 from the second remote control device 62, by means of which the drive unit of a selected articulation axis may be preferably operated in one of the main operating directions of the second remote control device 62.

What is claimed is:

1. A device for operating an articulated boom (22) connected to a boom base (21), said articulated boom (22) including at least three boom arms (23 to 27) which may each respectively be limitedly pivoted relative to the boom base (21) or relative to an adjacent boom arm (23 to 27) about parallel horizontal articulation axis (28 to 32) via respectively one drive unit (34 to 38), said boom base (21) mounted to a frame (11) and pivotable about a vertical axis (13) via a drive unit (19), said device for operating the articulated boom comprising a control device (74) for movement of the boom as well as a remote controller communicating with the control device via preferably a wireless data transmission pathway (68), said remote controller comprising a first and a second remote control device (60, 62), each of which being adjustable manually back and forth in at least one main operating direction and thus providing an output signal (64, 66), said control device (74) comprising a computer supported co-ordinate transformer (80), responsive to the output signal (64) from the first remote control device (60), via which the drive units (34 to 38) for the redundant articulation axes may be operated in the one main control direction (r) of the first remote control device (60) independent of the drive unit (19) for the rotation of the boom base (21) and in any rotation position of the boom base, for extending or retracting the articulated boom (14) according to the pattern of a predetermined path-slew relationship, wherein said control device (74) provides a correction routine (84) based on the output signal (66) from the second remote control device (62), via which, in one of the main operating directions ($\epsilon_v$) of the second remote control device (62), the drive unit of a selected articulation axis (j) is preferentially operated with maintaining the position set by the first remote control device (60) and/or movement of the boom distal end (33) by tracking or following the drive unit in at least one of the remaining articulation axis.

2. A device according to claim 1, wherein the control device (74) includes a correction routine (84) responsive to the output signal (66) of the second or a third remote control element (62), via which the angle of inclination of a selected boom arm (j) is adjustable within the vertical articulated boom plane in one of the main adjustment directions (s) of the concerned remote control element (62), while maintaining the condition or position and/or movement of the boom tip (33) entered by the first remote control element (60) during the further movement process.

3. A device for operating an articulated boom (22) connected to a boom base (21), said articulated boom (22) including at least three boom arms (23 to 27) which may each respectively be limitedly pivoted relative to the boom base (21) or relative to an adjacent boom arm (23 to 27) about parallel horizontal articulation axis (28 to 32) via respectively one drive unit (34 to 38), said boom base (21) mounted to a frame (11) and pivotable about a vertical axis (13) via a drive unit (19), said device for operating the articulated boom comprising a control device (74) for movement of the boom as well as a remote controller communicating with the control device via preferably a wireless data transmission pathway (68), said remote controller comprising a first and a second remote control device (60, 62), each of which being adjustable manually back and forth in at least one main operating direction and thus providing an output signal (64, 66), said control device (74) comprising a computer supported co-ordinate transformer (80), responsive to the output signal (64) from the first remote control device (60), via which the drive units (34 to 38) for the redundant articulation axes may be operated in the one main control direction (r) of the first remote control device (60) independent of the drive unit (19) for the rotation of the boom base (21) and in any rotation position of the boom base, for extending or retracting the articulated boom (14) according to the pattern of a predetermined path-slew relationship, wherein the control device (74) includes a correction routine (84) responsive to the output signal (66) of the second or a third remote control element (62), via which the angle of inclination of a selected boom arm (j) within the vertical articulated boom plane is adjustable in one of the main adjustment directions (s) of the concerned remote control element (62), while maintaining the condition or position and/or movement of the boom tip (33) entered by the first remote control element (60) during the further movement process.

4. Device according to one of claims 1 through 3, wherein the control device (74) includes a correction routine (84) responsive to the output signal (66) of a further remote control element (62), via which in one of the main adjustment directions (5) of the concerned remote control element (62) the linkage of a selected articulated axis (j) is lockable, preferably with maintaining a predetermined bend angle ($\epsilon_v$).

5. A device for operating an articulated boom (22) connected to a boom base (21), said articulated boom (22) including at least three boom arms (23 to 27) which may each respectively be limitedly pivoted relative to the boom base (21) or relative to an adjacent boom arm (23 to 27) about parallel horizontal articulation axis (28 to 32) via respectively one drive unit (34 to 38), said boom base (21) mounted to a frame (11) and pivotable about a vertical axis (13) via a drive unit (19), said device for operating the articulated boom comprising a control device (74) for movement of the boom as well as a remote controller communicating with the control device via preferably a wireless data transmission pathway (68), said remote controller comprising a first and a second remote control device (60, 62), each of which being adjustable manually back and forth in at least one main operating direction and thus providing an output signal (64, 66), said control device (74) comprising a computer supported co-ordinate transformer (80), responsive to the output signal (64) from the first remote control device (60), via which the drive units (34 to 38) for the redundant articulation axes may be operated in the one main control direction (r) of the first remote control device (60) independent of the drive unit (19) for the rotation of the boom base (21) and in any rotation position of the boom base, for extending or retracting the articulated boom (14) according to the pattern of a predetermined path-slew relationship, wherein the control device (74) includes a correction routine (84) responsive to the output signal (66) of a further remote control element (62), via which in one of the main adjustment directions (s) of the concerned remote control element (62) the linkage of a selected articulated axis (j) is lockable, preferably with maintaining a predetermined bend angle ($\epsilon_v$).

6. A device as in one of claims 3, and 5, wherein said device is a concrete placement boom carrying a terminal hose (43) on the outboard end of the boom.

7. A device according to one of claims 1, 3 and 5, wherein the first remote control device (60) exhibits three main adjustment directions, which are associated with the coordinates ($\phi$,r,h) of the boom tip (33) in a cylindrical coordinate system based on the rotation axis (33) of the boom base (4).

8. A device according to one of claims 1, 3 and 5, further comprising a selection device (82) for selection of the articulation axes (j) operable by the second remote control device (62).

9. A device according to one of claims 2, 3 and 5, further comprising a selection device (82) for selection of the boom arm (j) storable in memory with respect to its angle of inclination via the second or third remote control element (62).

10. A device according to one of claims 3 and 5, characterized by a selection device (82) for selection of the articulation axis (j) to be stored for linkage locking via the second remote control device (62).

11. A device according to one of claims 1, 3 and 5, wherein the control device (74) includes an interpolation routine (76) responsive to the magnitude of the output signal (64, 66) of the remote control device (60, 62) for adjusting and limiting the movement speed and/or acceleration of the drive units (19, 34 through 38).

12. A device according to one of claims 1, 3 and 5, wherein the coordinate transformer (80) includes a transformation routine for converting the cylinder coordinates ($\phi$,r, h) defined by the output signal (64) of the first remote control device (60) in angle or path coordinates ($\phi$,$\epsilon_{Ti}$) depending upon the value of the predetermined or pre-input path-slew characteristic.

13. A device according to claim 12, wherein the individual drive units (19, 34 to 38) are respectively associated with one angle or path measurement system (96), and wherein the coordinate transformer (80) is connected to a downstream position or orientation controller (92) which is influenced by the output data of the angle or path measurement system as an actual value.

14. A device according to claim 11, wherein the coordinate transformer (80) and the correction routine (84) at their output side are connected with a coordinate adder (86), of which the output data influences the intended value input of the position or condition controller (92).

15. A device according to claim 14, wherein the output data of the coordinate adder (86) is coupled back to the input side of the coordinate transformer (80) via a forward transformation routine (88) and a coordinate comparator (90).

16. A large scale manipulator, comprising a boom base (21) provided on a vehicle frame (11), rotatable about a vertical rotation axis (13) via a drive unit (19), an articulated boom (22) comprised of at least three boom arms (23 through 27) to form a concrete distribution boom, which boom arms (23 through 27) are respectively limitedly pivotable via respectively one further drive unit (34 through 38), a control device (74) for moving the boom, a remote controller (50) communicating with the control device via a data transmission path (68), which remote controller includes a first and a second remote control device (60, 62) moveable back and forth by hand in respectively at least one main adjustment direction and thereby emitting an output signal (64, 66), wherein the control device (74) includes a computer supported coordinate transformer (80) responsive to the output signal (64) of the first remote control device (60), via which the drive units (34 through 38) of the redundant articulated axes (28 to 32) are moveable or operable in the one main adjustment direction (r) of the first remote control device (60), independent of the drive unit (90) of the boom base (21), for carrying out an extension or retraction movement of the articulated boom (14) according to the value of a predetermined path-slew characteristic, and wherein the control device (74) includes a correction routine (84) responsive to the output signal (66) of the second remote control device (62), via which in one of the main adjustment directions ($\epsilon$v) of the second remote control device (62) the drive unit of a selected articulation axes (j) is preferentially operable while maintaining the orientation and/or movement of the boom tip (33) as input by the first remote control device (60) by following or subordinating of the drive unit of at least one of the remaining articulated axes.

17. A large scale manipulator as in claim 16, wherein said large manipulator is for a concrete pump.

18. A large scale manipulator as in claim 17, wherein said manipulator carries a distribution hose (43) on its boom tip (33).

19. A large scale manipulator as in claim 16, wherein said remote controller (50) communicates with the control device over a wireless data transmission path (68).

20. A large scale manipulator according to claim 16, wherein the control device (74) includes a correction routine (84) responsive to the output signal (66) of the second or a third remote control device (62), via which in one of the main adjustment directions (s) of the concerned remote control device (62) the inclination angle relative to the vertical articulated boom plane of a selected boom arm (j) is adjustable while maintaining the orientation and/or movement of the boom tip (33) input by the first remote control device (60) for the remaining movement.

21. A large scale manipulator, comprising a boom base (21) provided on a vehicle frame (11), rotatable about a vertical rotation axis (13) via a drive unit (19), an articulated boom (22) comprised of at least three boom arms (23 through 27) to form a concrete distribution boom, which boom arms (23 through 27) are respectively limitedly pivotable via respectively one further drive unit (34 through 38), a control device (74) for moving the boom, a remote controller (50) communicating with the control device via a data transmission path (68), which remote controller includes a first and a second remote control device (60, 62) moveable back and forth by hand in respectively at least one main adjustment direction and thereby emitting an output signal (64, 66), wherein the control device (74) includes a computer supported coordinate transformer (80) responsive to the output signal (64) of the first remote control device (60) via which the drive units (34 through 38) of the redundant articulated axes (28 to 32) are moveable or operable in the one main adjustment direction (r) of the first remote control device (60), independent of the drive unit (90) of the boom base (21), for carrying out an extension or retraction movement of the articulated boom (14) according to the value of a predetermined path-slew characteristic, and wherein the control device (74) includes a correction routine (84) responsive to the output signal (66) of the second or a third remote control device (62), via which in one of the main adjustment directions (s) of the concerned remote control device (62) the inclination angle relative to the vertical articulated boom plane of a selected boom arm (j) is adjustable while maintaining the orientation and/or movement of the boom tip (33) input by the first remote control device (60) for the remaining movement.

22. A large scale manipulator according to claim 21, further carrying a distribution hose (43) on its boom tip (33).

23. A large scale manipulator according to claim 21, wherein the control device (74) includes a correction routine (84) responsive to the output signal (66) of a further remote control device (62), via which the linkage of one of the selected articulation axes (j) is lockable in one of the main adjustment direction (s) of the concerned remote control device (62).

24. A large scale manipulator according to claim 23, wherein the linkage of one of the selected articulation axes (j) is lockable in one of the main adjustment direction (s) of the concerned remote control device (62) at a predetermined articulation angle ($\epsilon v$).

25. A large scale manipulator for a concrete pump, comprising a boom base (21) provided on a vehicle frame (11), rotatable about a vertical rotation axis (13) via a drive unit (19), an articulated boom (22) comprised of at least three boom arms (23 through 27) to form a concrete distribution boom, which boom arms (23 through 27) are respectively limitedly pivotable via respectively one further drive unit (34 through 38), a control device (74) for moving the boom, a remote controller (50) communicating with the control device over a preferably wireless data transmission path (68), which remote controller includes a first and a second remote control device (60, 62) moveable back and forth by hand in respectively at least one main adjustment direction back and forth and thereby emitting an output signal (64, 66), wherein the control device (74) includes a computer supported coordinate transformer (80) responsive to the output signal (64) of the first remote control device (60), via which the drive units (34 through 38) of the redundant articulated axes (28 to 32) are moveable or operable in the one main adjustment direction (r) of the first remote control device (60), independent of the drive unit (90) of the boom base (21), for carrying out an extension or retraction movement of the articulated boom (14) according to the value of a predetermined path-slew characteristic, and wherein the control device (74) includes a correction routine (84) responsive to the output signal (66) of a further remote control device (62), via which the linkage of one of the selected articulation axes (j) is lockable in one of the main adjustment direction (s) of the concerned remote control device (62), preferably at a predetermined articulation angle ($\epsilon_v$).

26. A large scale manipulator according to one of claims 21 and 25, wherein the first remote control device (60) exhibits three main adjustment directions, which are associated with the coordinates ($\phi$,r,h) of the boom tip (33) in a cylindrical coordinate system referenced to a vehicle frame fixed rotation axes (33) of the boom base (21).

27. A large scale manipulator according to one of claims 21 and 25, comprising a selection device (82) for selection of the articulation axes (j) via the second remote control device (62).

28. A large scale manipulator according to one of claims 21 and 25, including a selection device (82) for selection of an inclination angle of a boom arm (j) via the second or third remote control device (62).

29. A large scale manipulator according to one of claims 21 and 25, including a selection device (82) for selection of the articulation axes (j) to be locked via the further remote control device (62).

30. A large scale manipulator according to one of claims 21 and 25, wherein the control device (74) includes an interpolation routine (76) responsive to the value of the output signal (64, 66) of the remote control device (60, 62) for adjusting and limiting the movement speed and/or acceleration of the drive units (19, 34 to 38).

31. A large scale manipulator according to one of claims 21 and 25, wherein the coordinate transformer (80) includes a transformation routine for converting the cylindrical coordinates ($\phi$,r,h) defined by the output signals (64) of the first remote control device (60) into angles or path coordinates ($\phi,\epsilon_{Ti}$) depending upon the value of the predetermined path-slew characteristic.

32. A large scale manipulator according to claim 31, wherein the individual drive units (19, 34 through 38) are associated with an angle or path measuring system (96), and that the coordinate transformer (80) has downstream a position or condition controller (92) acted upon by the output data of the angle or path measuring system as actual value.

* * * * *